United States Patent [19]

Grim

[11] Patent Number: 4,760,403

[45] Date of Patent: Jul. 26, 1988

[54] POLARIZED SIGNAL RECEIVER PROBE PROVIDED WITH A BIFURCATED TRANSMISSION LINE

[76] Inventor: Fay Grim, 565 Newburgh, Port Charlotte, Fla. 33952

[21] Appl. No.: 850,740

[22] Filed: Apr. 11, 1986

Related U.S. Application Data

[63] Continuation-in-part of Ser. No. 820,721, Jan. 21, 1986, which is a continuation-in-part of Ser. No. 796,284, Nov. 8, 1985, which is a continuation-in-part of Ser. No. 621,119, Jun. 15, 1984, Pat. No. 4,554,553.

[51] Int. Cl.[4] ..... H01Q 13/00

[52] U.S. Cl. ..... 343/786; 343/789; 343/791

[58] Field of Search ..... 343/786, 789, 791

[56] References Cited

U.S. PATENT DOCUMENTS 4,528,528 7/1985 Augustin ..... 343/786

*Primary Examiner*—Robert E. Wise
*Assistant Examiner*—Hoanganh Le
*Attorney, Agent, or Firm*—Gifford, Groh, VanOphem, Sheridan, Sprinkle and Dolgorukov

[57] ABSTRACT

A polarized signal receiver waveguide assembly, or feedhorn, for receiving a selected one of linearly polarized electromagnetic signals in one waveguide of circular cross-section and for launching or transmitting the selected signal into a second waveguide, the axes of the waveguides being disposed at right angle. The first waveguide has a closed end wall, formed as a hemispherical cavity having a hemispherical concave surface. A probe comprising a signal receiver portion disposed in a plane perpendicular to the axis of the first waveguide and a launch or re-transmitter portion having its axis perpendicular to the axis of the second waveguide has its launch or transmitter portion mounted in a controllably rotatable dielectric rod, such that rotation of the rod causes rotation of the signal receiver portion for alignment with a selected one of the polarized signals. The transmission line between the probe signal receiver portion and launch or re-transmitter portion consists of a pair of bifurcated curvilinear branches forming a rectangle disposed along the axis of the first waveguide and having sides bent at an angle in the form of angled and tapered winglets, rearwardly converging.

12 Claims, 2 Drawing Sheets

POLARIZED SIGNAL RECEIVER PROBE PROVIDED WITH A BIFURCATED TRANSMISSION LINE

CROSS REFERENCE TO RELATED APPLICATIONS

The present application is a continuation-in-part of application Ser. No. 820,721, filed Jan. 21, 1986 for Polarized Signal Receiver Waveguides and Probe, which is in turn a continuation-in-part of application Ser. No. 796,284, filed Nov. 8, 1985 for Polarized Signal Receiver Waveguides, which is a continuation-in-part of application Ser. No. 621,119, filed June 15, 1984 for Polarized Signal Receiver Probe, now U.S. Pat. No. 4,554,553, issued Nov. 19, 1984.

BACKGROUND OF THE INVENTION

The present invention relates to polarized signal receiver waveguides in general, or so-called "feedhorns", as used in dish antennas for TVRO (televisions receive only) systems, and more particularly to a novel receiver probe for signal receiving and signal transmitting waveguides.

The RF signals transmitted by communication satellite transponders consist of two linearly polarized signals, rotated 90° from each other. The linearly polarized signals reflected by the dish are received through the open end of a feedhorn, installed at the focus of the dish and comprising a cylindrical waveguide of circular cross-section. Only one of the two polarized signals is received, the other signal being reflected out of the feedhorn. The detected signal is fed through a second waveguide, generally a waveguide having a rectangular cross-section, whose axis is conventionally disposed at 90° to the axis of the feedhorn waveguide, and which feeds the detected signal to a low-noise amplifier (LNA).

Various antenna probe arrangements may be used for receiving one of the polarized signals in the feedhorn circular waveguide and for launching, or re-transmitting the detected signal into the rectangular waveguide. Generally, the antenna probe comprises a receiver portion disposed in the circular waveguide, and a signal launch or re-transmitter portion disposed in the rectangular waveguide, the probe being supported by a rotatable dielectric rod driven by a servomotor mounted on the waveguide assembly. The launch or re-transmitter portion of the probe has its axis aligned with the axis of the circular waveguide and with the axis of the dielectric rod, such as to remain constantly perpendicular to the axis of the rectangular waveguide during rotation of the probe. The probe receiver portion has its longitudinal axis perpendicular to the axis of rotation such as to rotate between the two orthogonally polarized signals in the circular waveguide. By rotation to a desired position, one polarized signal is received and the other is reflected. The received signal is conducted by the transmission line portion of the probe through the rear wall of the circular waveguide and is launched or re-transmitted into the rectangular waveguide by the probe launch or re-transmitter portion.

As the waveguide assembly is installed in an outdoor TVRO dish antenna, the assembly is exposed to inclement weather, such as rain or snow, dust and high wind, and to atmospheric pollution, all adverse conditions that may cause rapid deterioration, corrosion of the metallic surfaces and loosening of the joint between the waveguides. There results further deterioration of the relatively low level ultra-high frequency signals captured by the antenna system.

The invention disclosed in U.S. Pat. No. 4,554,553 is an improvement upon the prior art polarized signal receiver, transmission and launch probes for receiving a selected one of linearly polarized electromagnetic signals in one waveguide and for launching the selected signal into a second waveguide, the axes of the waveguides being disposed at right angle. The probe comprises a signal receiver portion disposed in a plane perpendicular to the axis of the first waveguide and a launch or re-transmitting portion having its axis perpendicular to the axis of the second waveguide. The probe launch portion is mounted in a controllably rotatable dielectric rod, such that rotation of the rod causes rotation of the signal receiver portion for alignment with a selected one of the polarized signals. The transmission line between the signal receiver probe portion and the signal launch probe portion consists of a pair of bifurcated branches forming a rectangle disposed along the axis of the first waveguide.

The invention disclosed in co-pending application Ser. No. 820,721 provides a single-piece waveguide assembly having a hemispherical concave rear end wall for a circularly cylindrical waveguide, and a rotatable probe provided with a transmission line between the receiver portion of the probe and the launching or re-transmitting portion of the probe which is contoured to the hemispherical shape of the wall.

SUMMARY OF THE INVENTION

The present invention provides a novel receiver probe structure which is a modification of the probe disclosed in U.S. Pat. No. 4,554,553, and which is used in a feedhorn having a circularly cylindrical first waveguide provided with a hemispherical concave rear end wall, and which provides good impedance match and a good signal to noise ratio, without the requirement that any portion of the transmission line between the probe receiver portion and the probe launching or re-transmitting portion be parallel to either the rear wall of the circularly cylindrical waveguide or to the sidewall of the circularly cylindrical waveguide.

A better understanding of the present invention and of its many objects and advantages will be obtained by those skilled in the art from the following description of the best mode contemplated for practicing the invention, when read in conjunction with the accompanying drawing wherein:

DETAILED DESCRIPTION OF THE PREFERRED EMBODIMENT

Figure 1:
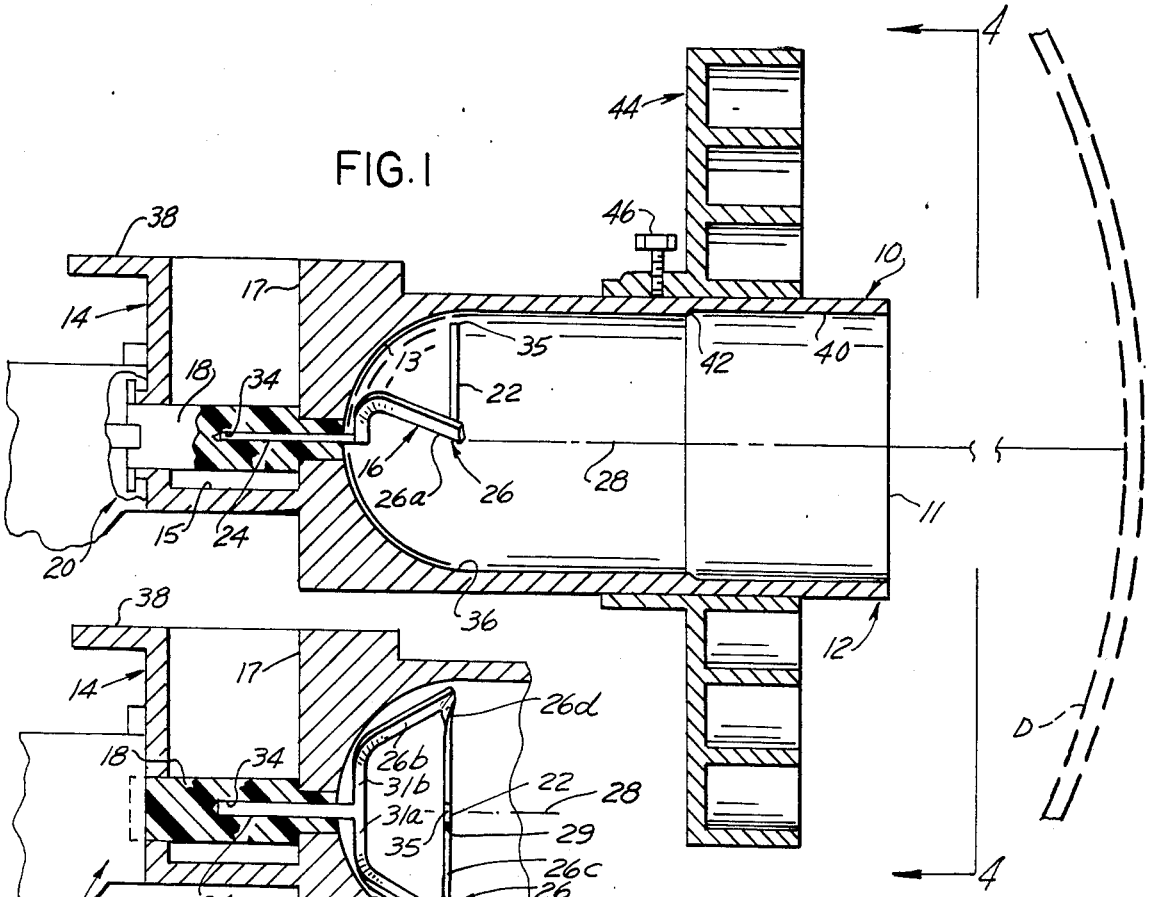
FIG. 1 is a longitudinal sectional view of a waveguide and receiver probe assembly according to the invention.
Figure 4:
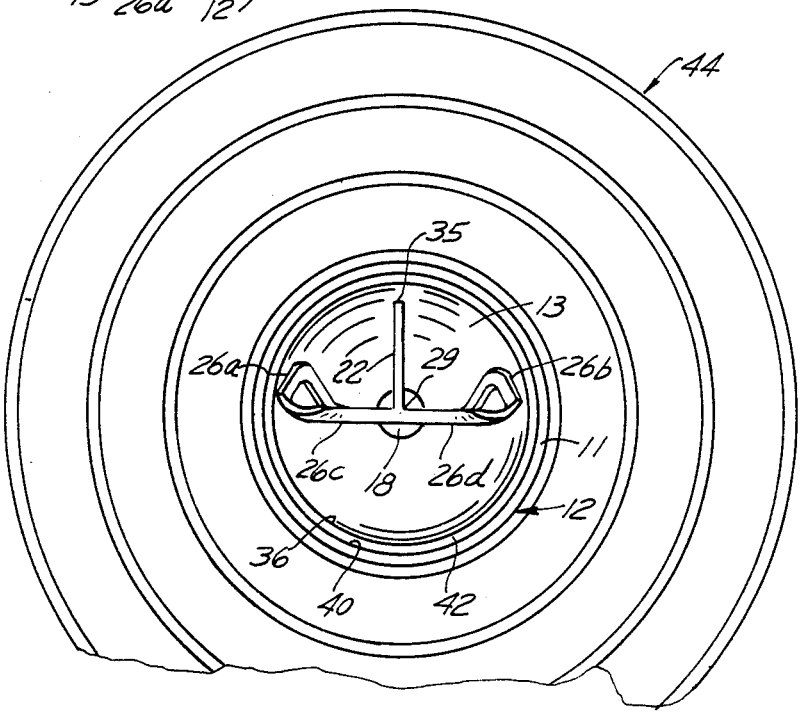
FIG. 4 is a front elevation view thereof, from line 4—4 of FIG. 2.

Referring now to the drawing, and more particularly to FIGS. 1 and 4, there is illustrated a feedhorn 10 for reception of satellite transmitted television signals or other RF signals of ultra-high frequency, for example in the 3.7 to 4.2 GHz range, as presently used. The feedhorn 10 is generally used installed at the focus of a parabolic reflector dish, shown schematically at D at FIG. 1, such that the RF microwaves are reflected into the open end 11 of the feedhorn 10.

The feedhorn 10 is made principally of a pair of waveguides 12 and 14, cast integrally of metal or metal alloy such as, for example, aluminum alloy. The waveguide 12 is a circularly cylindrical waveguide, i.e. circular in cross-section, while the waveguide 14 is a rectangular waveguide, i.e. rectangular in cross-section.

The circularly cylindrical waveguide 12 has a substantially hemispherical concave integral rear wall 13 and is disposed with its longitudinal axis at right angle to the longitudinal axis of the rectangular waveguide 14 formed integrally at the closed end, or hemispherical concave rear wall 13, of the circularly cylindrical waveguide 12. The rectangular waveguide 14 is closed at one end by an end or rear wall 15 and is coupled at its open end to a low-noise signal amplifier (LNA), not shown. A probe 16 is fixedly mounted coaxially in a dielectric rod or shaft 18 disposed rotatable through the hemispherical concave rear wall 13 of the circularly cylindrical waveguide which is integral with a corresponding sidewall 17 of the rectangular waveguide 14. The dielectric rod or shaft 18 and the probe 16 are driven in rotation by a servomotor 20.

Figure 5:
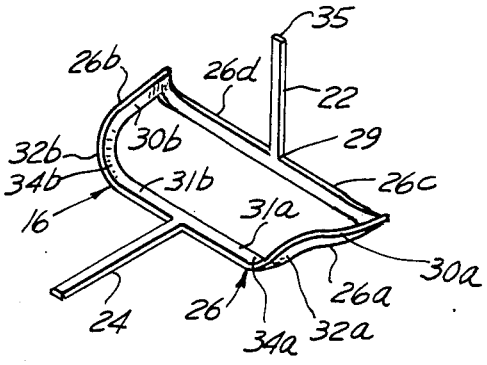
FIG. 5 is a perspective view of the receiver probe of the invention.
Figure 6:
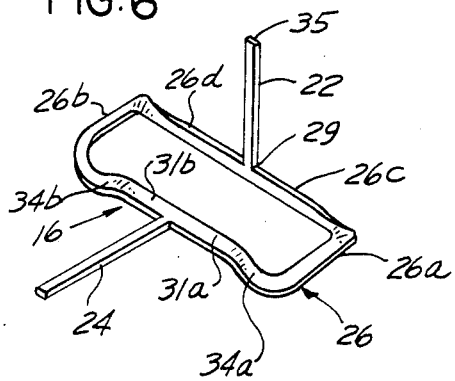
FIG. 6 is a perspective view of a modification of the probe.
Figure 7:
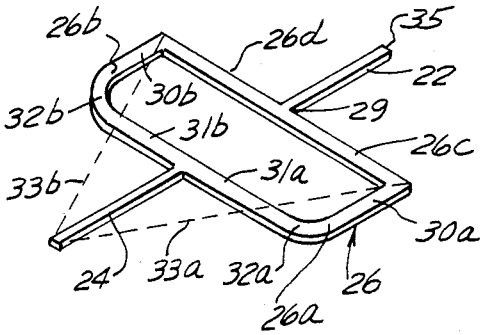
FIG. 7 is a perspective view of an example of stamping from which the probes of FIGS. 5 and 6 may be made.

The probe 16 is made of a single continuous electrical conductor and, preferably, of a single-piece precision casting or stamping of electrically conductive metal or alloy. The structure illustrated in the drawing is that of a probe 16 made of a single-piece stamping, given for illustrative purpose and shown at FIG. 7 in its blanked out form prior to having been further processed to the shape illustrated at FIGS. 1-5. The probe 16, FIGS. 1-5, comprises a receiver portion 22, approximately one-quarter wavelength long, having its longitudinal axis disposed in a plane perpendicular to the longitudinal axis 28, or axis of symmetry of the circularly cylindrical waveguide 12, and a signal launch, or re-transmitter, portion 24 held within the dielectric rod 18 with its longitudinal axis aligned with the longitudinal axis, or axis of symmetry, 28 of the circular waveguide 12. The probe signal launch or re-transmitter portion 24 projects within the rectangular waveguide 14, perpendicularly to the longitudinal axis of the waveguide 14. The probe signal receiver portion 22 and signal launch or re-transmitter portion 24 are integrally connected by a transmission line portion 26. The transmission line portion 26 takes the form of a pair of generally U-shaped symmetrically disposed bifurcated branches and comprises two symmetrically disposed curvilinear branches 26*a* and 26*b*, and two symmetrically disposed aligned straight portions 26*c* and 26*d*, equal in length, each having an end integrally attached to a forward end of one of the branches 26*a* and 26*b* and another end integrally attached to the bottom 29 of the probe signal receiver portion 22. The curvilinear branch 26*a* of the transmission line 26 has, as best shown at FIGS. 5-7, a straight portion 30*a* disposed at right angle to the straight portion 26*c* and a straight portion 31*a* disposed substantially parallel to the straight portion 26*c*. Similarly, the curvilinear portion 26*b* of the transmission line 26 has a straight portion 30*b* disposed symmetrically to the straight portion 30*a* and a straight portion 31*b* aligned to the straight portion 31*a* and substantially perpendicular to the launch or re-transmitter portion 24 of the probe. The straight portion 30*a* is joined integrally to the straight portion 31*a* by a relatively small radius curved portion 32*a*, while the straight portion 30*b* is joined to the straight portion 31*b* by an integral small radius portion 32*b*. Such an arrangement is best shown at FIG. 6 which represents the probe 16 of the invention prior to bending to final shape, and it is to be noted that the transmission line 26 is substantially in the form of a rectangle having a long side 26*c*-26*d* to which is integrally attached the receiver portion 22 of the probe and a substantially parallel long side 31*a*-31*b* which is integrally attached to the launch or re-transmitter portion 24 of the probe, the rectangle formed by the transmission line 26 having opposite short sides 30*a* and 30*b*. Although the short side 30*a* is shown connected to the half long side 31*a* by a curved portion 32*a* and the short side 30*b* is shown connected to the half long side 31*b* by a curved portion 32*b*, it will be readily appreciated that the junction between the short sides 30*a* and the half long side 31*a*, on one hand and the short side 30*b* and the half long side 31*b*, on the other hand, may be a sharp right angle junction as shown with respect to the connection of the sides 30*a* and 30*b*, respectively, with the portions 26*c* and 26*d* of the transmission line 26.

From the stamped blank of FIG. 7, the finished probe 16 of FIGS. 1-5 is obtained by bending the receiver probe portion 22 at a right angle to the plane of the transmission line 26 or, in other words, to the plane of the rectangle defining the transmission line 26. The short sides of the rectangle defined by the portion 30*a* and 30*b* and by the curved portion 32*a* and 32*b*, in the structure illustrated at FIGS. 1-5, are bent upwardly, i.e. in the same direction as the receiving portion 22 of the probe to approximately an angle of 120° to the plane of the original rectangle forming the transmission line 26 in the form of angled and tapered "winglets", rearwardly converging. The bends are effected each along an axis of one of two imaginary lines, such as lines 33*a* and 33*b*, as shown at FIG. 7, which are drawn from the tip of the junction of the side 30*a* with the half side 26*c* and the side 30*b* and the half side 26*d*, respectively of the rectangle, the lines 33*a* and 33*b* converging substantially at the tip of the re-transmitter or launch portion 24 of the probe. In the structure illustrated, the bending at the junction of the sides 30*a* and 26*c* and at the junction of the sides 30*b* and 26*d* is effected at a relatively sharp angle while the bending around the axis of the imaginary lines 33*a* and 33*b* where each intersects respectively the half side 31*a* and the half side 31*b* of the rectangle is effected with a radius as shown at 34*a* and 34*b*, respectively at FIG. 5. Instead of being effected upwardly, i.e. in the same direction as the probe receiver portion 22, the bending of the "winglets" may be effected in an opposite direction.

The probe 16 is installed for rotation by the dielectric rod 18 as a result of the launch or re-transmitter portion 24 of the probe being introduced in the longitudinal bore 34 formed in the dielectric rod and being held therein by cementing or bonding. Once installed, the launch or re-transmitter portion 24 of the probe 16 projects within the rectangular waveguide 14, the straight portions 26c and 26d of the transmission line 26 extend substantially along a diameter of the circularly cylindrical waveguide 12, while the receiver probe portion 22 projects from the integral end-to-end junction of the aligned straight branches 26c and 26d, orthogonal to the axis 28 of symmetry of the circular waveguide 12 and, consequently, also orthogonal to the axis of rotation of the probe 16. The tip 35 of the receiver probe portion 22 is substantially adjacent to the cylindrical inner wall 36 of the circularly cylindrical waveguide 12, substantially at the intersection of the cylindrical wall 36 with the hemispherical concave rear wall 13.

Equality of the lengths of the transmission line branches 26c and 26d, 26a and 26b and 31a and 31b, is critical for minimizing signal strength losses between the probe signal receiver portion 22 and the probe signal launch or re-transmitter portion 24. Accurate fabrication of the probe 16, such as by precision casting or stamping and accurate bending, results in providing equal length branches 31a and 31b, 26a and 26b, and 26c and 26d, for the transmission line 26, and in providing accurate one-quarter wavelength for the probe signal receiver portion 22, for better rejection of unwanted signals, and improved signal-to-noise ratio performance.

Although there is no portion of the probe transmission line 26 disposed parallel to the hemispherical back wall 13 of the circularly cylindrical waveguide 12, and no portion parallel to the inner wall 36 of the circularly cylindrical waveguide 12, the particular configuration of the probe transmission line 26b between the probe signal receiver portion 22 and the signal launch or re-transmitter portion 24 results in a practically capacitanceless transmission line, and in good impedance match between the two waveguides 12 and 14. The length of the portions 26c and 26d of each branch, perpendicular to the axis 28 of the circular waveguide 12, is preferably one-quarter of a wavelength. The length of the probe launch or re-transmitter portion 24 is not critical, as long as the probe launch or re-transmitter portion 24 extends sufficiently into the rectangular waveguide 14 beyond the hemispherical concave end wall 13 of the circularly cylindrical waveguide 12. Typically, and only for the sake of convenience, the length of the launch probe portion 24 extending into the rectangular waveguide 14 is approximately 1/6 of the wavelength.

Figure 2:
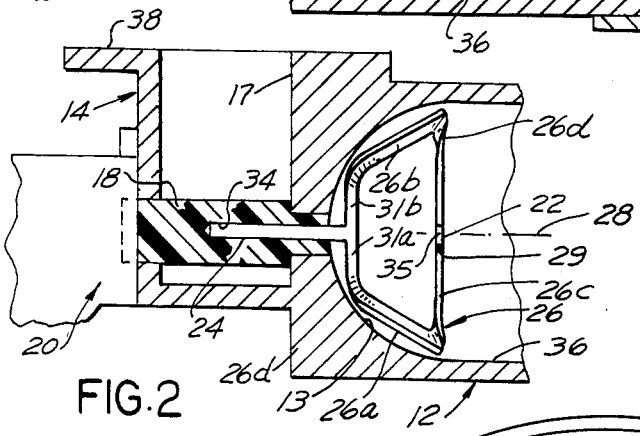
FIG. 2 is a partial view similar to FIG. 1, but showing the receiver probe rotated 90° from the position shown at FIG. 1.
Figure 3:
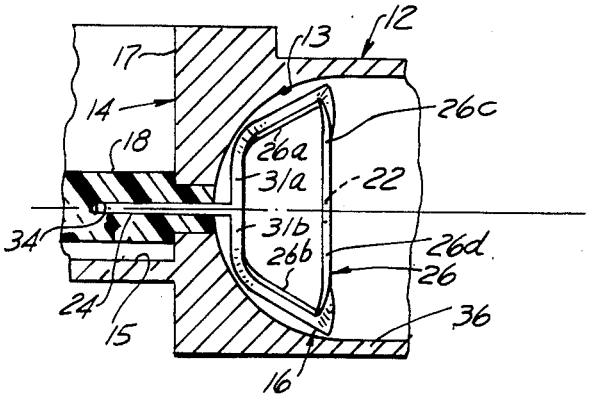
FIG. 3 is a view similar to FIG. 2, but showing the receiver probe rotated 90° from the position shown at FIG. 2.

In operation, the probe 16, FIGS. 1–3, is rotatively driven, from a remote control location, by way of the servomotor 20 rotating the dielectric rod or shaft 18, thus causing the probe signal receiver portion 22 to sweep a substantially circular plane in the circularly cylindrical waveguide 12, perpendicular to the axis 28. As the probe signal receiver portion 22 aligns itself with the desired linearly polarized signal in the circularly cylindrical waveguide 12, the detected signal is transmitted through the bifurcated transmission line 26 to the probe signal launch or re-transmitter portion 24 projecting in the rectangular waveguide 14. The desired orientation of the probe signal receiver portion 22 is determined by a peak in the detected signal. The signal launched in the rectangular waveguide 14 by the probe signal launch or re-transmitter portion 24 is evidently unaffected by the rotation of the probe 16, because the probe signal launch or transmitter portion 24 rotates around the axis of symmetry 28 of the circularly cylindrical waveguide 12.

The rectangular waveguide 14 is provided at its open end with a flange 38, FIG. 1, for coupling to an appropriate input waveguide of the LNA. The circularly cylindrical waveguide 12 is provided at its open end 11 with an internally enlarged diameter portion 40 forming a shoulder 42 at the junction between the internal cylindrical surface 36 of the circularly cylindrical waveguide 12 and the internal surface of its enlarged diameter portion 40. The step or shoulder 42 acts as a reference shoulder for an appropriate depth gauge, not shown, for exact location, during assembly, of the probe 16 into the dielectric rod 18 for determining the longitudinal positioning of the probe receiver portion 22 in the circularly cylindrical waveguide 12. The probe 16 is attached to the dielectric rod or shaft 18 as a result of the probe launch or transmitter portion 24 being cemented or bonded in the axially disposed central bore 34 in the dielectric rod 18.

The feedhorn 10 is provided with an adjustable "scaler" ring 44 which may be longitudinally positioned where most effective along the circular waveguide 12 and held in position by tightening the setscrews or bolts 46.

Having thus described the present invention by way of examples of structures well designed for accomplishing the objects of the invention, modifications whereof will be apparent to those skilled in the art, what is claimed as new is as follows:

1. In a polarized signal receiver comprising a first waveguide of circular cross-section for receiving polarized signals at one open end, said first waveguide having a rear wall, a second waveguide for transmitting polarized signals, a dielectric rod controllably rotatably mounted axially through the rear wall of said first waveguide, means for controllably rotating said dielectric rod and a signal transferring probe mounted in said dielectric rod concentric with the axis of rotation thereof, said signal transferring probe comprising a receiver portion disposed in said first waveguide in a plane orthogonal to the axis of said first waveguide for receiving one of the polarized signals in said first waveguide, a launch or re-transmitter portion extending into the second waveguide substantially perpendicular to the axis of said second waveguide, said launch or re-transmitter portion being disposed concentric with said dielectric rod and rotatable in unison with said dielectric rod, and a transmission line portion connecting said receiver portion to said launch or re-transmitter portion, the improvement comprising said transmission line portion having two integral oppositely directed and symmetrical generally U-shaped branch portions forming a rectangle disposed in said first waveguide, said rectangle having a first long side integrally connected to said signal receiver portion, a second long side connected to said launch or re-transmitter portion, and a pair of opposed short sides integrally connecting said long sides, said first long side and a portion of said second long side being disposed in a single plane along the axis of symmetry of said first waveguide and perpendicular to the plane in which said signal receiver portion is disposed, wherein each of said short sides of said rectangle and a corresponding end portion of said second long side form symmetrically disposed winglets in a second and third planes at an angle to said single plane.

2. The improvement of claim 1 wherein said winglets extend in the same direction as said signal receiver portion.

3. The improvement of claim 2 wherein each of said short sides of said rectangle and a corresponding end portion of said second long side are joined by an integral curved portion.

4. The improvement of claim 1 wherein said winglets extend in a direction opposite to said signal receiver portion.

5. The improvement of claim 4 wherein each of said short sides of said rectangle and a corresponding end portion of said second long side are joined by an integral curved portion.

6. The improvement of claim 1 wherein each of said short sides of said rectangle and a corresponding end portion of said second long side are joined by an integral curved portion.

7. In a polarized signal receiver comprising a first waveguide of circular cross-section for receiving polarized signals at one open end, said first waveguide having a rear wall, said rear wall being formed as a substantially hemispherical cavity having a substantially hemispherical concave surface, a second waveguide for transmitting polarized signals, a dielectric rod controllably rotatably mounted axially through the rear wall of said first waveguide, means for controllably rotating said dielectric rod and a signal transferring probe mounted in said dielectric rod concentric with the axis of rotation thereof, said signal transferring probe comprising a receiver portion disposed in said first waveguide in a plane orthogonal to the axis of said first waveguide for receiving one of the polarized signals in said first waveguide, a launch or re-transmitter portion extending into the second waveguide substantially perpendicular to the axis of said second waveguide, said launch or re-transmitter portion being disposed concentric with said dielectric rod and rotatable in unison with said dielectric rod, and a transmission line portion connecting said receiver portion to said launch or re-transmitter portion, the improvement comprising said transmission line portion having two integral oppositely directed and symmetrical generally U-shaped branch portions forming a rectangle disposed in said first waveguide, said rectangle having a first long side integrally connected to said signal receiver probe portion, a second long side connected to said launch or re-transmitter portion and a pair of opposed short sides integrally connecting said long sides, said first long side and a portion of said second long side being disposed in a single plane along the axis of symmetry of said first waveguide and perpendicular to the plane in which said signal receiver probe portion is disposed, wherein each of said short sides of said rectangle and a corresponding end portion of said second long side form symmetrically disposed winglets in a second and third planes at an angle to said single plane.

8. The improvement of claim 7 wherein said winglets extend in the same direction as said signal receiver portion.

9. The improvement of claim 8 wherein each of said short sides of said rectangle and a corresponding end portion of said second long side are joined by an integral curved portion.

10. The improvement of claim 7 wherein said winglets extend in a direction opposite to said signal receiver portion.

11. The improvement of claim 10 wherein each of said short sides of said rectangle and a corresponding end portion of said second long side are joined by an integral curved portion.

12. The improvement of claim 7 wherein each of said short sides of said rectangle and a corresponding end portion of said second long side are joined by an integral curved portion.

* * * * *